US011276362B2

(12) United States Patent
Zhang et al.

(10) Patent No.: US 11,276,362 B2
(45) Date of Patent: Mar. 15, 2022

(54) TFT ARRAY SUBSTRATE AND DISPLAY PANEL

(71) Applicant: Shenzhen China Star Optoelectronics Semiconductor Display Technology Co., Ltd., Guangdong (CN)

(72) Inventors: Liuqi Zhang, Guangdong (CN); Baixiang Han, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 399 days.

(21) Appl. No.: 16/497,985

(22) PCT Filed: May 27, 2019

(86) PCT No.: PCT/CN2019/088666

§ 371 (c)(1),
(2) Date: Sep. 26, 2019

(87) PCT Pub. No.: WO2020/211168

PCT Pub. Date: Oct. 22, 2020

(65) Prior Publication Data

US 2021/0366425 A1 Nov. 25, 2021

(30) Foreign Application Priority Data

Apr. 18, 2019 (CN) ..... 201910314782.9

(51) Int. Cl.
*G09G 3/3266* (2016.01)
*G09G 3/36* (2006.01)

(52) U.S. Cl.
CPC ..... *G09G 3/3677* (2013.01); *G09G 3/3266* (2013.01); *G09G 2300/0408* (2013.01);
(Continued)

(58) Field of Classification Search
CPC .. G09G 3/3266; G09G 3/3674; G09G 3/3677; G09G 2300/0408;
(Continued)

(56) References Cited

U.S. PATENT DOCUMENTS

2007/0086558 A1* 4/2007 Wei ..... G11C 19/28 377/64
2009/0021662 A1* 1/2009 Chang ..... G02F 1/1368 349/46
(Continued)

FOREIGN PATENT DOCUMENTS

CN 106486048 A 3/2017
CN 107393473 A 11/2017
JP H10253940 A 9/1998

*Primary Examiner* — Michael J Eurice

(57) ABSTRACT

A thin film transistor (TFT) and a display panel are provided. In the TFT array substrate, a first TFT is correspondingly disposed in each pixel of a plurality of pixels. Each first TFT in an (N)th row of pixels of the pixels correspondingly has a gate electrically connected to an (N+1)th scan line of a plurality of scan lines, a drain electrically connected to an (N)th scan line of the scan lines, and a source receiving a negative supply voltage. Therefore, a scan signal received by each pixel is individually pulled down by each pixel, thereby significantly reducing a falling time of the scan signal, and facilitating ensuring display quality of the display panel.

10 Claims, 9 Drawing Sheets

(52) U.S. Cl.
CPC ..... *G09G 2300/0819* (2013.01); *G09G 2310/0202* (2013.01); *G09G 2310/08* (2013.01)

(58) Field of Classification Search
CPC ... G09G 2300/0413; G09G 2300/0426; G09G 2300/0819; G09G 2310/0202; G09G 2320/0223; G09G 2310/0251; G09G 2320/0252; G09G 2320/0257; G09G 2310/0286; G09G 2310/08; G09G 1/13454; G02F 1/1362; G02F 1/136286; H01L 27/3248; H01L 27/3262; H01L 27/3276
See application file for complete search history.

(56) References Cited

U.S. PATENT DOCUMENTS

| | | | | |
|---|---|---|---|---|
| 2010/0079443 | A1* | 4/2010 | Chang | G09G 3/3677 345/214 |
| 2013/0278572 | A1* | 10/2013 | Lee | G09G 3/3648 345/204 |
| 2017/0213516 | A1* | 7/2017 | Cao | G09G 3/3674 |

* cited by examiner

TFT ARRAY SUBSTRATE AND DISPLAY PANEL

CROSS REFERENCE TO RELATED APPLICATIONS

This application claims the priority of International Application No. PCT/CN2019/088666, filed on May 27, 2019, which claims priority to Chinese Application No. 201910314782.9, filed on Apr. 18, 2019. The entire disclosures of the above applications are incorporated herein by reference.

FIELD OF INVENTION

The present disclosure relates to a technical field of displays, and more particularly to a thin film transistor (TFT) array substrate and a display panel.

BACKGROUND OF INVENTION

Flat panel display devices such as liquid crystal displays (LCDs) and organic light emitting diode (OLED) display devices have advantages of having thin bodies, being power saving, and having no radiation. Flat panel display devices have wide applications such as liquid crystal televisions, mobile phones, personal digital assistants (PDAs), digital cameras, computer screens, and notebook screens.

Gate driver on array (GOA) technology is array substrate row driving technology. GOA technology forms gate scan driving circuits in the thin film transistor (TFT) array substrates of LCDs and OLED display devices using TFT array manufacturing processes, to realize a driving manner that performs scanning row-by-row. Therefore, GOA technology has advantages of reducing production costs and realizing slim frame designs of panels. GOA circuits have two basic functions: The first is to output a plurality of gate scan driving signals, correspondingly driving a plurality of gate lines in a panel, and correspondingly turning on a corresponding plurality of TFTs in an active area (AA), to correspondingly charge a corresponding plurality of pixels. The second is a shift register function. When outputting one gate scan driving signal of the gate scan driving signals is finished, outputting a next gate scan driving signal of the gate scan driving signals is performed by clock control, and so on sequentially. GOA technology may reduce bonding processes of external integrated circuits (ICs), has opportunities to increase production capacities and lower product costs, and may make LCD panels more suitable for manufacturing slim-frame display products.

Referring to FIG. 1, an existing TFT array substrate that uses GOA technology includes a substrate 100, a plurality of pixels 200 disposed on the substrate 100, a plurality of scan lines 300 disposed on the substrate 100, a plurality of data lines 400, and a GOA circuit 500. The substrate 100 includes an AA 110 and a non-AA 120 at a periphery of the AA 110. The pixels 200 are arranged in an array and are all located in the AA 110. The GOA circuit 500 is located in the non-AA 120. The scan lines 300 are all electrically connected to the GOA circuit 500. Each row of pixels 200 of the pixels 200 is correspondingly connected to one scan line 300 of the scan lines 300. Each column of pixels 200 of the pixels 200 is correspondingly connected to one data line 400 of the data lines 400. When the GOA circuit 500 drives, the GOA circuit 500 correspondingly and sequentially provides a plurality of scan signals to the scan lines 300 correspondingly in each frame period to correspondingly turn on a plurality of TFTs correspondingly in a corresponding plurality of pixels 200 of the pixels 200. Therefore, the corresponding plurality of pixels 200 are charged correspondingly through a corresponding plurality of data lines 400 of the data lines 400. In the related art, each scan signal of the scan signals is correspondingly pulled down by one pull-down unit of a plurality of pull-down units inside the GOA circuit 500. However, when the GOA circuit 500 transmits each scan signal correspondingly to the corresponding plurality of pixels 200 in the AA 110 correspondingly through one scan line 300 of the scan lines 300, a large amount of capacitance and a large amount of resistance are inevitably generated. Under effects of these capacitance and resistance, a rising time and a falling time correspondingly of each scan signal are both increased. The increase of the falling time is especially severe. Referring to FIG. 2, this causes a waveform correspondingly of each scan signal correspondingly actually received by the corresponding plurality of pixels 200 is seriously distorted, thereby correspondingly generating a corresponding plurality of driving errors correspondingly causing the corresponding plurality of pixels 200 to be mischarged. Therefore, image display is affected.

SUMMARY OF INVENTION

An object of the present disclosure is to provide a thin film transistor (TFT) array substrate to reduce a falling time correspondingly of each scan signal of a plurality of scan signals, thereby facilitating ensuring display quality of a display panel.

Another object of the present disclosure is to provide a display panel to reduce a falling time correspondingly of each scan signal of a plurality of scan signals, thereby facilitating ensuring display quality.

In order realize the aforementioned objects, the present disclosure first provides the TFT array substrate, including: a substrate, a plurality of pixels disposed on the substrate, a plurality of scan lines arranged in order on the substrate, and a gate driver on array (GOA) circuit disposed on the substrate.

The pixels are arranged in an array. The GOA circuit is located outside a region where the pixels are located. The scan lines are all connected to the GOA circuit, and each scan line is correspondingly electrically connected to one row of pixels of the pixels. Each pixel of the pixels correspondingly includes a first TFT, and except for a last row of pixels of the pixels, each first TFT of an (N)th row of pixels of the pixels correspondingly has a gate electrically connected to an (N+1)th scan line of the scan lines, a drain electrically connected to an (N)th scan line of the scan lines, and a source receiving a negative supply voltage, where N is a positive integer.

The substrate includes an active area (AA) and a non-AA at a periphery of the AA; and wherein the pixels are all located in the AA, and the GOA circuit is located in the non-AA.

The TFT array substrate further includes: a plurality of data lines disposed on the substrate, wherein each column of pixels of the pixels is correspondingly electrically connected to one data line of the data lines.

Each pixel of the pixels correspondingly further includes: a second TFT, a first capacitor, and a pixel electrode. The second TFT has a gate electrically connected to a corresponding scan line of the scan lines, a source electrically connected to a corresponding data line of the data lines, and a drain electrically connected to the pixel electrode. The first capacitor has one end electrically connected to the pixel electrode and another end being grounded.

Each pixel of the pixels correspondingly further includes: a third TFT, a fourth TFT, a second capacitor, and an anode. The third TFT correspondingly has a gate electrically connected to a corresponding scan line of the scan lines, a source electrically connected to a corresponding data line of the data lines, and a drain electrically connected to a gate of the fourth TFT. The fourth TFT has a drain receiving a positive supply voltage, and a source electrically connected to the anode. The second capacitor has one end electrically connected to the anode and another end being grounded.

The GOA circuit correspondingly and sequentially transmits a plurality of scan signals to the scan lines in one frame period.

Each first TFT of the last row of pixels correspondingly has a gate receiving a start signal, a drain electrically connected to a last scan line of the scan lines, and a source receiving the negative supply voltage.

The GOA circuit includes multi-stage GOA units, each stage of the multi-stage GOA units is correspondingly electrically connected to one scan line of the scan lines, and each stage of the multi-stage GOA units correspondingly includes a pull-up controlling module, a pull-up module, a down transfer module, a pull-down module, a pull-down maintaining module, and a boost capacitor.

Except for a first stage GOA unit and a last stage GOA unit of the multi-stage GOA units, in an (n)th stage GOA unit of the multi-stage GOA units, where n is a positive integer, the pull-up controlling module, the pull-up module, the down transfer module, the pull-down maintaining module, and the boost capacitor are provided as follows.

The pull-up controlling module includes an eleventh TFT, a twelfth TFT, and a thirteenth TFT. The eleventh TFT has a gate receiving a first clock signal, a source receiving a stage transfer signal of an (n−1)th stage GOA unit of the multi-stage GOA units, and a drain electrically connected to a source of the twelfth TFT. The twelfth TFT has a gate receiving the first clock signal, and a drain electrically connected to a first node. The thirteenth TFT has a gate electrically connected the down transfer module, a source electrically connected to the drain of the eleventh TFT, and a drain electrically connected to a second node.

The pull-up module includes a twenty-first TFT and a twenty-second TFT. The twenty-first TFT has a gate electrically connected to the first node, a source receiving a second clock signal, and a drain electrically connected to a corresponding scan line of the scan lines and outputting a scan signal. The twenty-second TFT has a gate electrically connected to the first node, a source receiving the second clock signal, and a drain electrically connected to the second node.

The down transfer module includes a thirty-first TFT. The thirty-first TFT has a gate electrically connected to the first node, a source receiving the second clock signal, and a drain electrically connected to the gate of the thirteenth TFT and outputting the stage transfer signal.

The pull-down module includes a forty-first TFT, a forty-second TFT, and a forty-third TFT. The forty-first TFT has a gate receiving a scan signal of an (n+1)th stage GOA unit of the multi-stage GOA units, a source electrically connected to the first node, and a drain electrically connected to a source of the forty-second TFT. The forty-second TFT has a gate receiving the scan signal of the (n+1)th stage GOA unit, and a drain receiving a first constant low voltage. The forty-third TFT has a gate receiving the scan signal of the (n+1)th stage GOA unit, a source electrically receiving the scan signal, and a drain receiving a second constant low voltage.

The pull-down maintaining module includes a fifty-first TFT, a fifty-second TFT, a fifty-third TFT, a fifty-fourth TFT, a fifty-fifth TFT, a fifty-sixth TFT, a fifty-seventh TFT, a fifty-eighth TFT, and a fifty-ninth TFT. The fifty-first TFT has a gate and a source both receiving a constant high voltage, and a drain electrically connected to a source of the fifty-second TFT. The fifty-second TFT has a gate electrically connected to the first node, and a drain receiving the first constant low voltage. The fifty-third TFT has a gate electrically connected to the drain of the fifty-first TFT, a source receiving the constant high voltage, and a drain electrically connected to a source of the fifty-fourth TFT. The fifty-fourth TFT has a gate electrically connected to the first node, and a drain receiving the first constant low voltage. The fifty-fifth TFT has a gate electrically connected to the drain of the fifty-third TFT, a source electrically connected to the first node, and a drain electrically connected to the drain of the eleventh TFT. The fifty-sixth TFT has a gate electrically connected to the drain of the fifty-third TFT, a source electrically to the drain of the fifty-fifth TFT, and a drain receiving the first constant low voltage. The fifty-seventh TFT has a gate electrically connected to the drain of the fifty-third TFT, a source receiving the stage transfer signal, and a drain receiving the first constant low voltage. The fifty-eighth TFT has a gate electrically connected to the drain of the fifty-third TFT, a source electrically connected to the second node, and a drain receiving the second constant low voltage. The fifty-ninth TFT has a gate electrically connected to the drain of the fifty-third TFT, a source receiving the scan signal, and a drain receiving the second constant low voltage.

The boost capacitor has one end electrically connected to the first node, and another end receiving the scan signal.

In the first stage GOA unit, the source of the eleventh TFT receives a start signal. In the last stage GOA unit, the gate of the forty-first TFT, the gate of the forty-second TFT, and the gate of the forty-third TFT receive the start signal.

The present disclosure also provides the display panel, including any of the aforementioned TFT array substrates.

Advantages of the present disclosure are as follows: In the TFT array substrate, a first TFT is correspondingly disposed in each pixel of a plurality of pixels. Each first TFT in an (N)th row of pixels of the pixels correspondingly has a gate electrically connected to an (N+1)th scan line of a plurality of scan lines, a drain electrically connected to an (N)th scan line of the scan lines, and a source receiving a negative supply voltage. Therefore, a scan signal of a plurality of scan signals received by each pixel is individually pulled down by each pixel, thereby significantly reducing a falling time of the scan signal, and facilitating ensuring display quality of the display panel. The display panel of the present disclosure may reduce a falling time correspondingly of each scan signal of the scan signals, thereby facilitating ensuring display quality.

DESCRIPTION OF DRAWINGS

In order to further understand features and technical content of the present disclosure, please refer to the detail description and the drawings of the present disclosure below. However, the drawings are only used for reference and for illustration, and are not used to limit the present disclosure.

DETAILED DESCRIPTION OF PREFERRED EMBODIMENTS

In order to further describe technical means used by the present disclosure and effects thereof, preferred embodiments of the present disclosure are described in detail below in conjunction with the drawings thereof.

Figure 1:
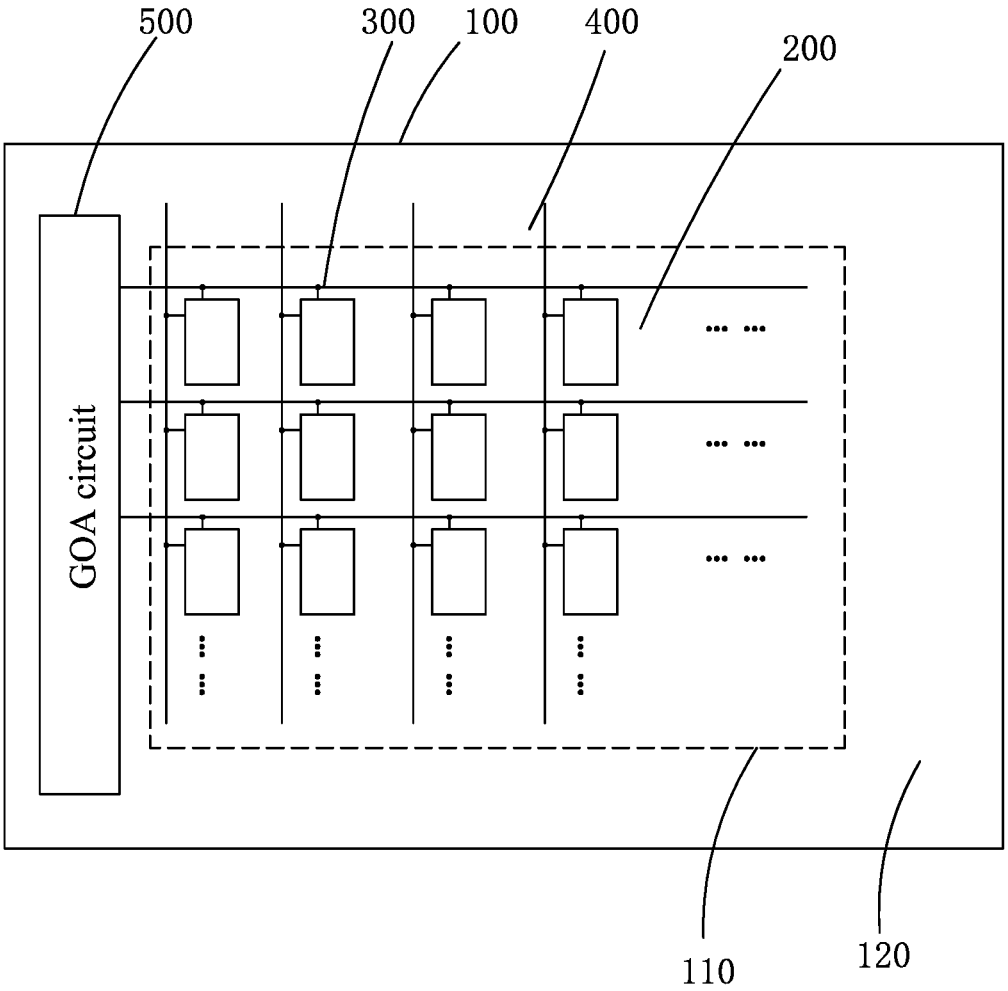
FIG. 1 (Prior Art)
FIG. 1 is a schematic structural diagram of a thin film transistor (TFT) array substrate using existing gate driver on array (GOA) technology.
Figure 2:
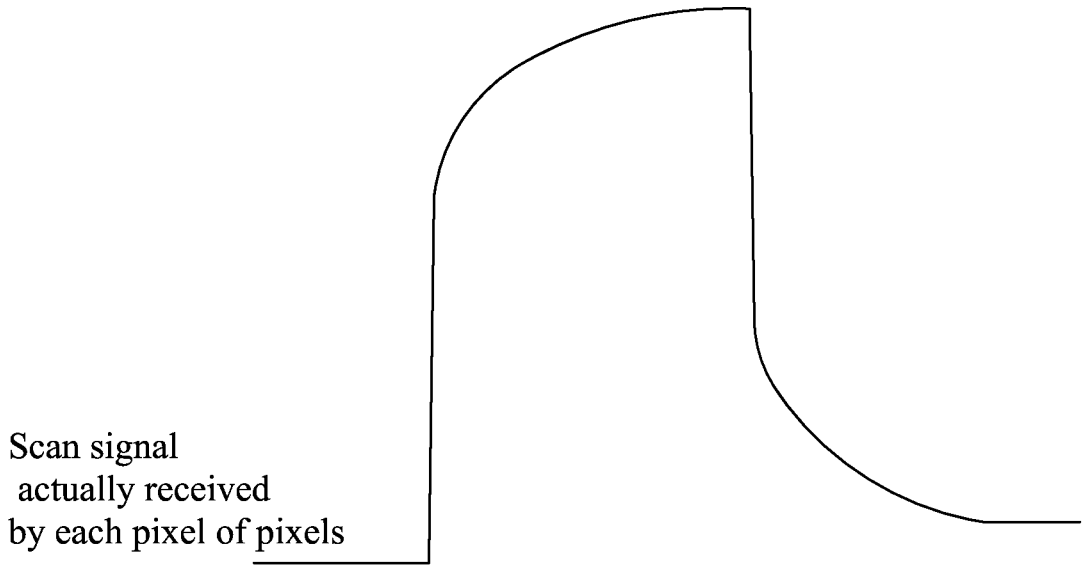
FIG. 2 (Prior Art)
FIG. 2 is a waveform diagram of a scan signal of a plurality of scan signals actually received by each pixel of a plurality of pixels in the TFT array substrate in FIG. 1.
Figure 3:
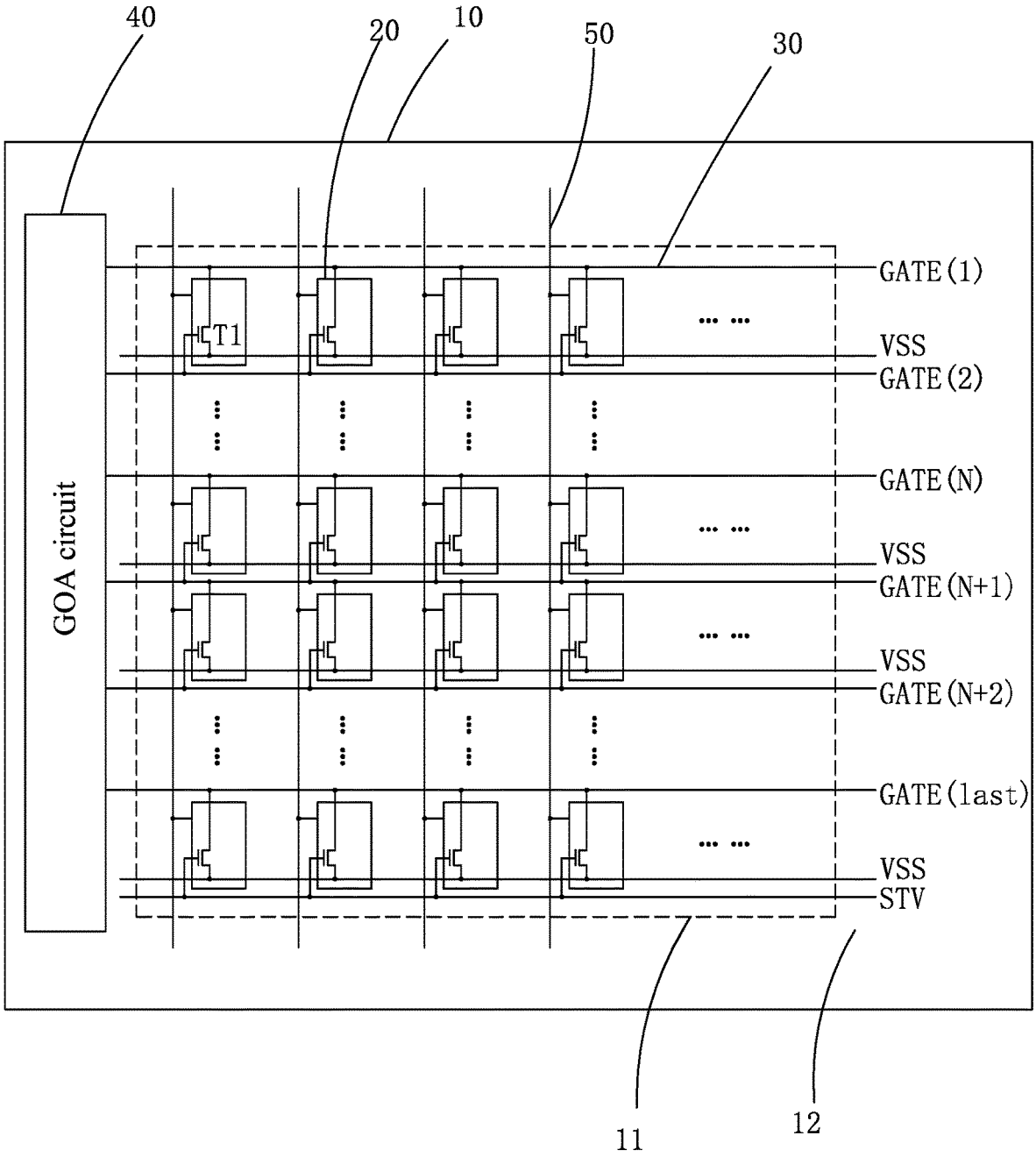
FIG. 3 is a schematic structural diagram of an TFT array substrate of the present disclosure.

Referring to FIG. 3, the present disclosure provides a thin film transistor (TFT) array substrate including a substrate 10, a plurality of pixels 20 disposed on the substrate 10, a plurality of scan lines 30 (GATE(1), GATE(2), . . . , GATE(N), GATE(N+1), GATE(N+2), . . . , GATE(last)) arranged in order on the substrate 10, and a gate driver on array (GOA) circuit 40 disposed on the substrate 10.

The pixels 20 are arranged in an array. The GOA circuit 40 is located outside a region where the pixels 20 are located. The scan lines 30 are all connected to the GOA circuit 40, and each scan line 30 is correspondingly electrically connected to one row of pixels 20 of the pixels 20. Each pixel 20 of the pixels 20 correspondingly includes a first TFT T1, and except for a last row of pixels 20 of the pixels 20, each first TFT T1 of an (N)th row of pixels 20 of the pixels 20 correspondingly has a gate electrically connected to an (N+1)th scan line GATE(N+1) of the scan lines 30, a drain electrically connected to an (N)th scan line GATE(N) of the scan lines 30, and a source receiving a negative supply voltage VSS, where N is a positive integer.

Specifically, the substrate 10 includes an active area (AA) 11 and a non-AA 12 at a periphery of the AA 11. The pixels 20 are all located in the AA 11, and the GOA circuit 40 is located in the non-AA 12.

Specifically, the TFT array substrate further includes: a plurality of data lines 50 disposed on the substrate 10, wherein each column of pixels 20 of the pixels 20 is correspondingly electrically connected to one data line 50 of the data lines 50.

Figure 4:
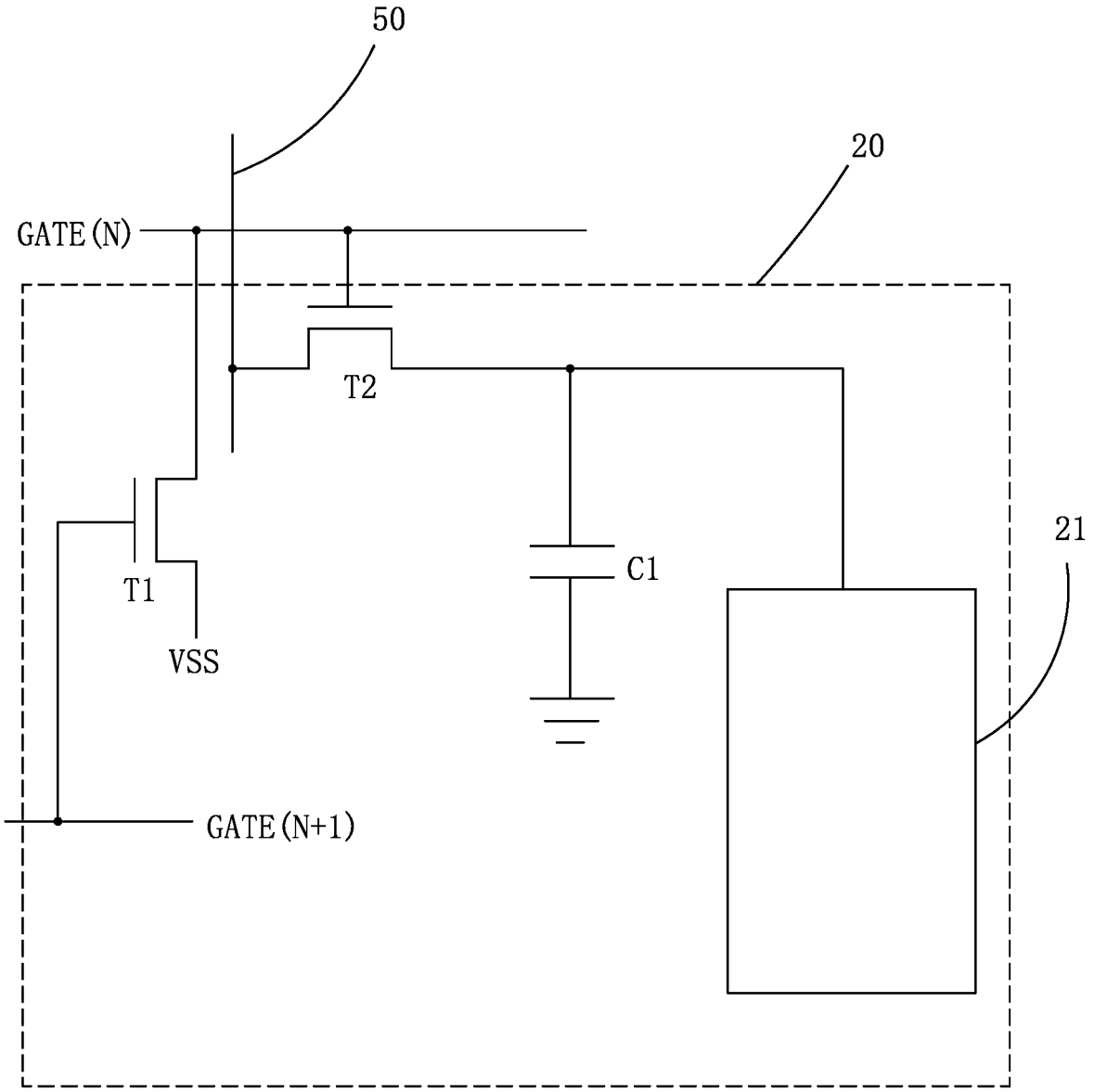
FIG. 4 is a schematic structural diagram of a pixel in an (N)th row of pixels of a plurality of pixels in the TFT array substrate of a first embodiment of the present disclosure.

Specifically, referring also to FIG. 4, in a first embodiment of the present disclosure, the TFT array substrate is a TFT array substrate of a liquid crystal display (LCD) panel. Each pixel 20 of the pixels 20 correspondingly further includes: a second TFT T2, a first capacitor C1, and a pixel electrode 21. The second TFT T2 has a gate electrically connected to a corresponding scan line 30 of the scan lines 30, a source electrically connected to a corresponding data line 50 of the data lines 50, and a drain electrically connected to the pixel electrode 21. The first capacitor C1 has one end electrically connected to the pixel electrode 21 and another end being grounded.

Figure 5:
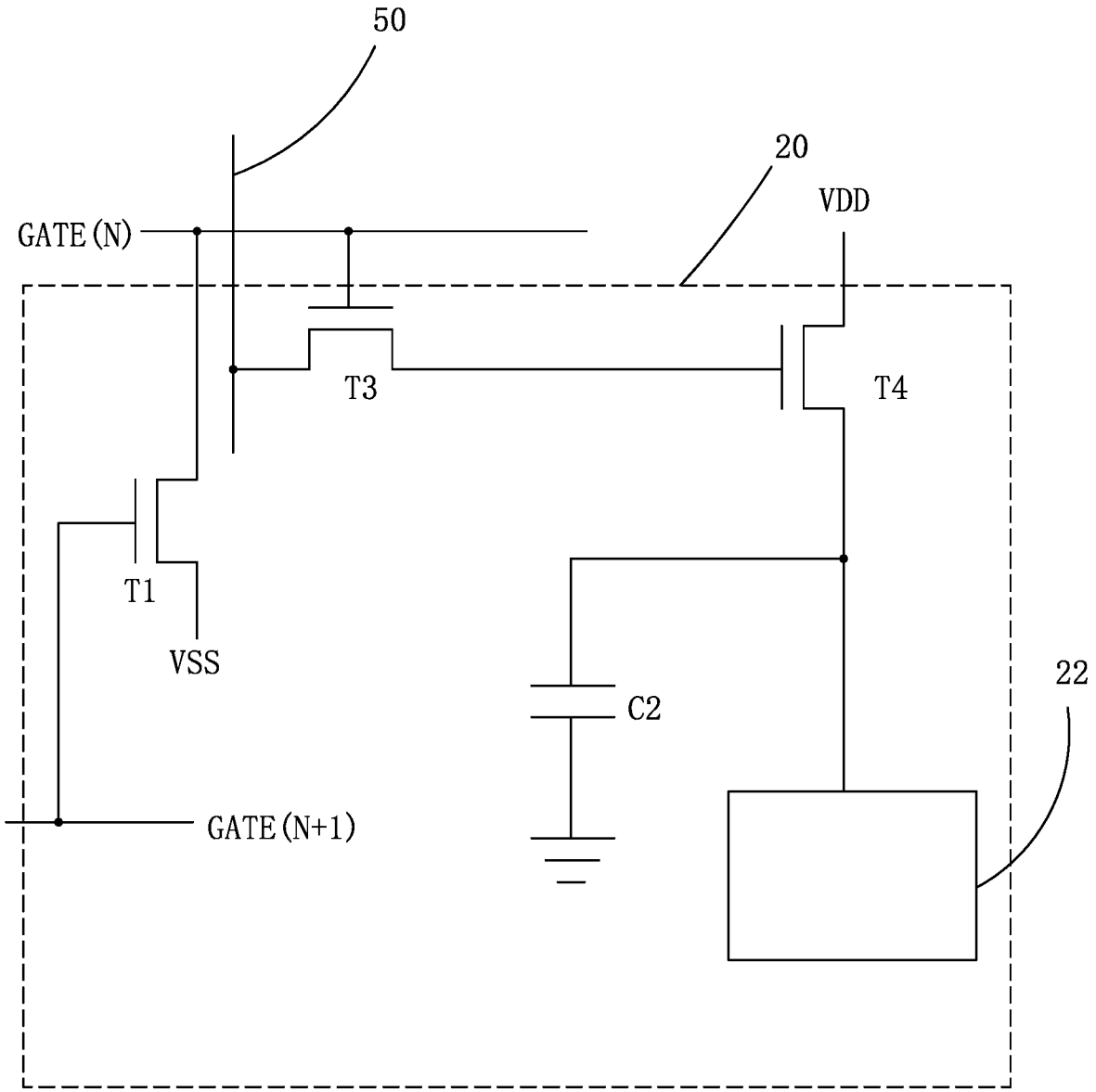
FIG. 5 is a schematic structural diagram of a pixel in an (N)th row of pixels of a plurality of pixels in the TFT array substrate of a second embodiment of the present disclosure.

Specifically, referring also to FIG. 5, in a second embodiment of the present disclosure, the TFT array substrate is a TFT array substrate of an organic light emitting diode (OLED) display panel. Each pixel 20 of the pixels 20 correspondingly further includes: a third TFT T3, a fourth TFT T4, a second capacitor C2, and an anode 22. The third TFT T3 correspondingly has a gate electrically connected to a corresponding scan line 30 of the scan lines 30, a source electrically connected to a corresponding data line 50 of the data lines 50, and a drain electrically connected to a gate of the fourth TFT T4. The fourth TFT T4 has a drain receiving a positive supply voltage VDD, and a source electrically connected to the anode 22. The second capacitor C2 has one end electrically connected to the anode 22 and another end being grounded.

Specifically, the GOA circuit 40 correspondingly and sequentially transmits a plurality of scan signals to the scan lines 30 in one frame period.

Specifically, referring to FIG. 3, each first TFT T1 of the last row of pixels 20 correspondingly has a gate receiving a start signal STV, a drain electrically connected to a last scan line GATE(last) of the scan lines 30, and a source receiving the negative supply voltage VSS.

Figure 6:
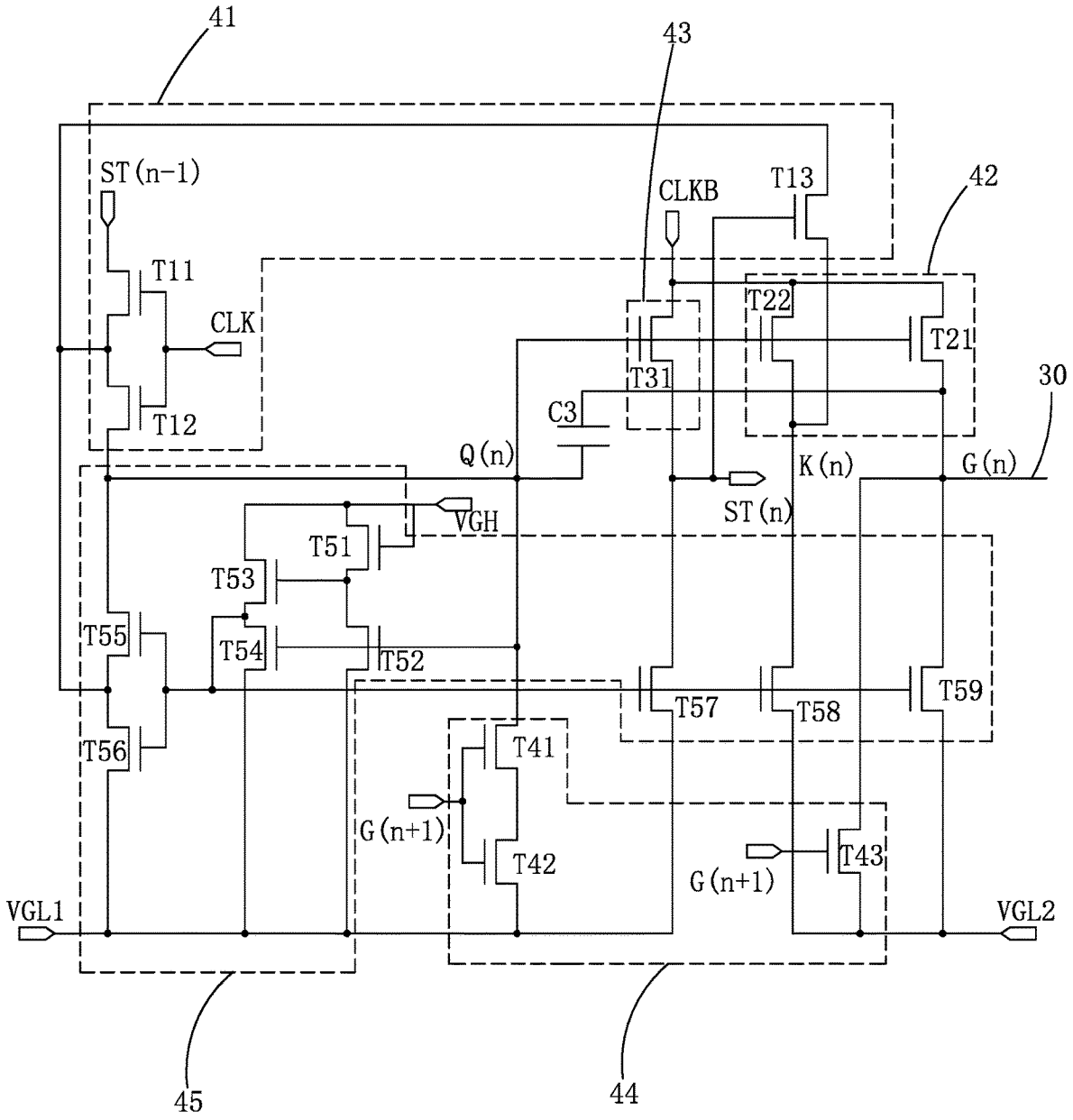
FIG. 6 is a circuit diagram of an (N)th stage GOA unit of multi-stage GOA units in the TFT array substrate of a preferred embodiment of the present disclosure.

Specifically, the GOA circuit 40 in the present disclosure may use any of existing GOA circuit structures. For example, referring to FIG. 6, in a preferred embodiment of the present disclosure, the GOA circuit 40 includes multi-stage GOA units, each stage of the multi-stage GOA units is correspondingly electrically connected to one scan line 30 of the scan lines 30, and each stage of the multi-stage GOA units correspondingly includes a pull-up controlling module 41, a pull-up module 42, a down transfer module 43, a pull-down module 44, a pull-down maintaining module 45, and a boost capacitor C3.

Except for a first stage GOA unit and a last stage GOA unit of the multi-stage GOA units, in an (n)th stage GOA unit of the multi-stage GOA units, where n is a positive integer, the pull-up controlling module 41, the pull-up module 42, the down transfer module 43, the pull-down module 44, the pull-down maintaining module 45, and the boost capacitor C3 are provided as follows.

The pull-up controlling module 41 includes an eleventh TFT T11, a twelfth TFT T12, and a thirteenth TFT T13. The eleventh TFT T11 has a gate receiving a first clock signal CLK, a source receiving a stage transfer signal ST(n−1) of an (n−1)th stage GOA unit of the multi-stage GOA units, and a drain electrically connected to a source of the twelfth TFT T12. The twelfth TFT T12 has a gate receiving the first clock signal CLK, and a drain electrically connected to a first node Q(n). The thirteenth TFT T13 has a gate electrically connected the down transfer module 43, a source electrically connected to the drain of the eleventh TFT T11, and a drain electrically connected to a second node K(n).

The pull-up module 42 includes a twenty-first TFT T21 and a twenty-second TFT T22. The twenty-first TFT T21 has a gate electrically connected to the first node Q(n), a source receiving a second clock signal CLKB, and a drain electrically connected to a corresponding scan line 30 of the scan lines 30 and outputting a scan signal G(n). The twenty-second TFT T22 has a gate electrically connected to the first node Q(n), a source receiving the second clock signal CLKB, and a drain electrically connected to the second node K(n).

The down transfer module 43 includes a thirty-first TFT T31. The thirty-first TFT T31 has a gate electrically connected to the first node Q(n), a source receiving the second clock signal CLKB, and a drain electrically connected to the gate of the thirteenth TFT T13 and outputting the stage transfer signal ST(n).

The pull-down module 44 includes a forty-first TFT T41, a forty-second TFT T42, and a forty-third TFT T43. The forty-first TFT T41 has a gate receiving a scan signal G(n+1) of an (n+1)th stage GOA unit of the multi-stage GOA units, a source electrically connected to the first node Q(n), and a drain electrically connected to a source of the forty-second TFT T42. The forty-second TFT T42 has a gate receiving the scan signal G(n+1) of the (n+1)th stage GOA unit, and a drain receiving a first constant low voltage VGL1. The forty-third TFT T43 has a gate receiving the scan signal G(n+1) of the (n+1)th stage GOA unit, a source electrically receiving the scan signal G(n), and a drain receiving a second constant low voltage VGL2.

The pull-down maintaining module 45 includes a fifty-first TFT T51, a fifty-second TFT T52, a fifty-third TFT T53, a fifty-fourth TFT T54, a fifty-fifth TFT T55, a fifty-sixth TFT T56, a fifty-seventh TFT T57, a fifty-eighth TFT T58, and a fifty-ninth TFT T59. The fifty-first TFT T51 has a gate and a source both receiving a constant high voltage VGH, and a drain electrically connected to a source of the fifty-second TFT T52. The fifty-second TFT T52 has a gate electrically connected to the first node Q(n), and a drain receiving the first constant low voltage VGL1. The fifty-third TFT T53 has a gate electrically connected to the drain of the fifty-first TFT T51, a source receiving the constant high voltage VGH, and a drain electrically connected to a source of the fifty-fourth TFT T54. The fifty-fourth TFT T54 has a gate electrically connected to the first node Q(n), and a drain receiving the first constant low voltage VGL1. The fifty-fifth TFT T55 has a gate electrically connected to the drain of the fifty-third TFT T53, a source electrically connected to the first node Q(n), and a drain electrically connected to the drain of the eleventh TFT T11. The fifty-sixth TFT T56 has a gate electrically connected to the drain of the fifty-third TFT T53, a source electrically to the drain of the fifty-fifth TFT T55, and a drain receiving the first constant low voltage VGL1. The fifty-seventh TFT T57 has a gate electrically connected to the drain of the fifty-third TFT T53, a source receiving the stage transfer signal ST(n), and a drain receiving the first constant low voltage VGL1. The fifty-eighth TFT T58 has a gate electrically connected to the drain of the fifty-third TFT T53, a source electrically connected to the second node K(n), and a drain receiving the second constant low voltage VGL2. The fifty-ninth TFT T59 has a gate electrically connected to the drain of the fifty-third TFT T53, a source receiving the scan signal G(n), and a drain receiving the second constant low voltage VGL2.

The boost capacitor C3 has one end electrically connected to the first node Q(n), and another end receiving the scan signal G(n).

Figure 7:
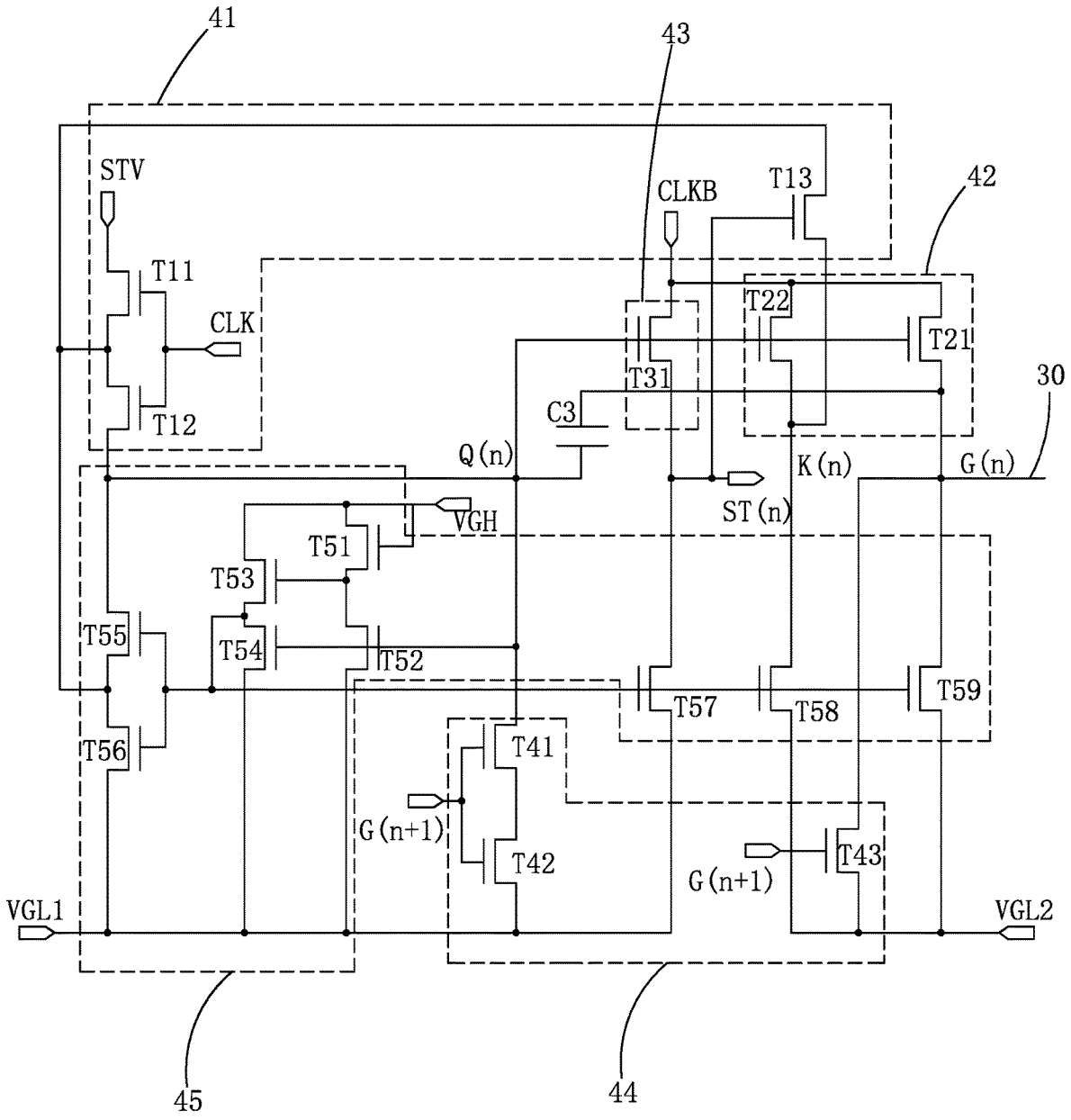
FIG. 7 is a circuit diagram of a first stage GOA unit of the multi-stage GOA units in the TFT array substrate of a preferred embodiment of the present disclosure.
Figure 8:
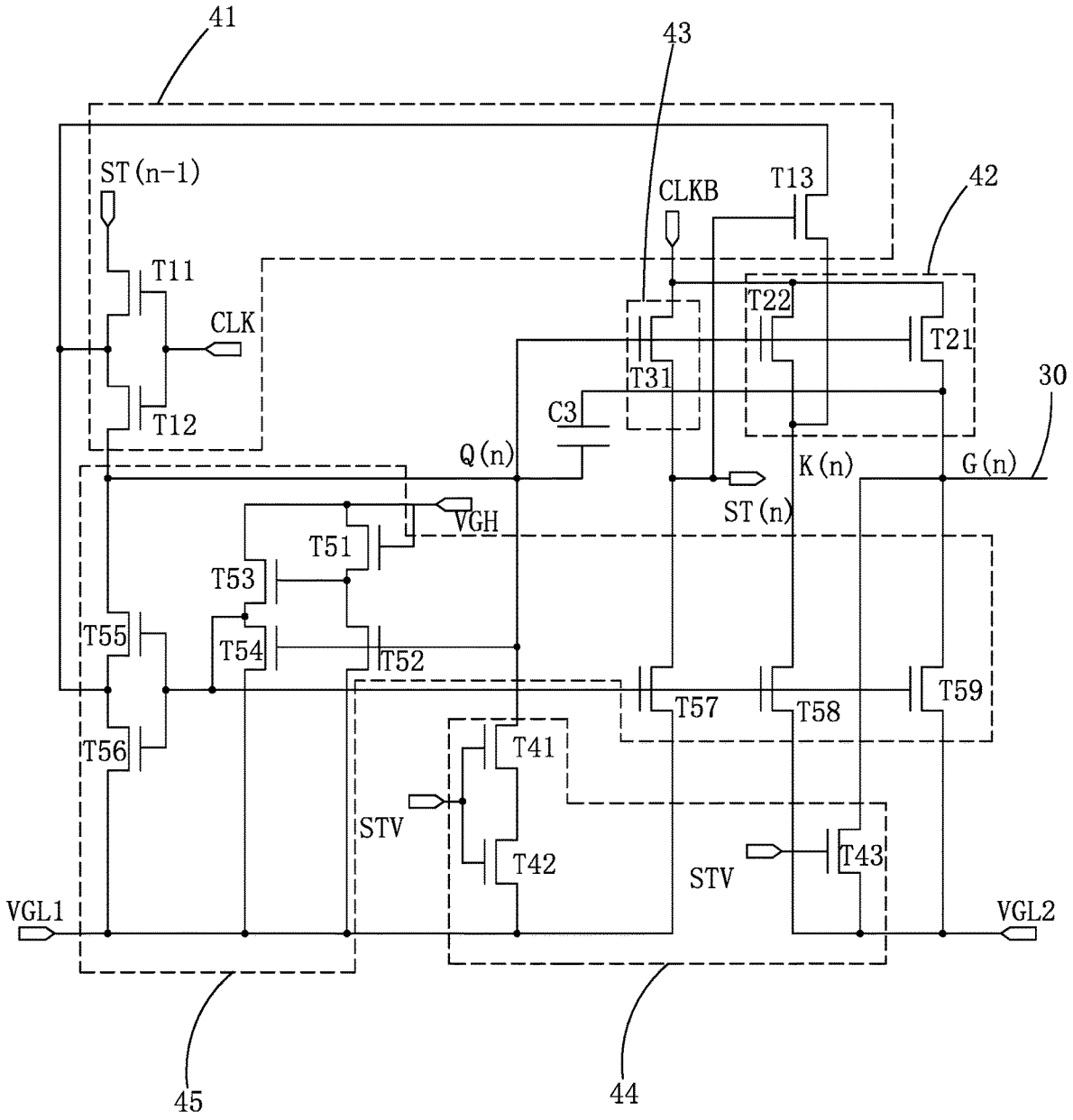
FIG. 8 is a circuit diagram of a last stage GOA unit of the multi-stage GOA units in the TFT array substrate of a preferred embodiment of the present disclosure.

Further, referring to FIG. 7, in the first stage GOA unit, the source of the eleventh TFT T11 receives a start signal STV. Referring to FIG. 8, in the last stage GOA unit, the gate of the forty-first TFT T41, the gate of the forty-second TFT T42, and the gate of the forty-third TFT T43 receive the start signal STV.

Figure 9:
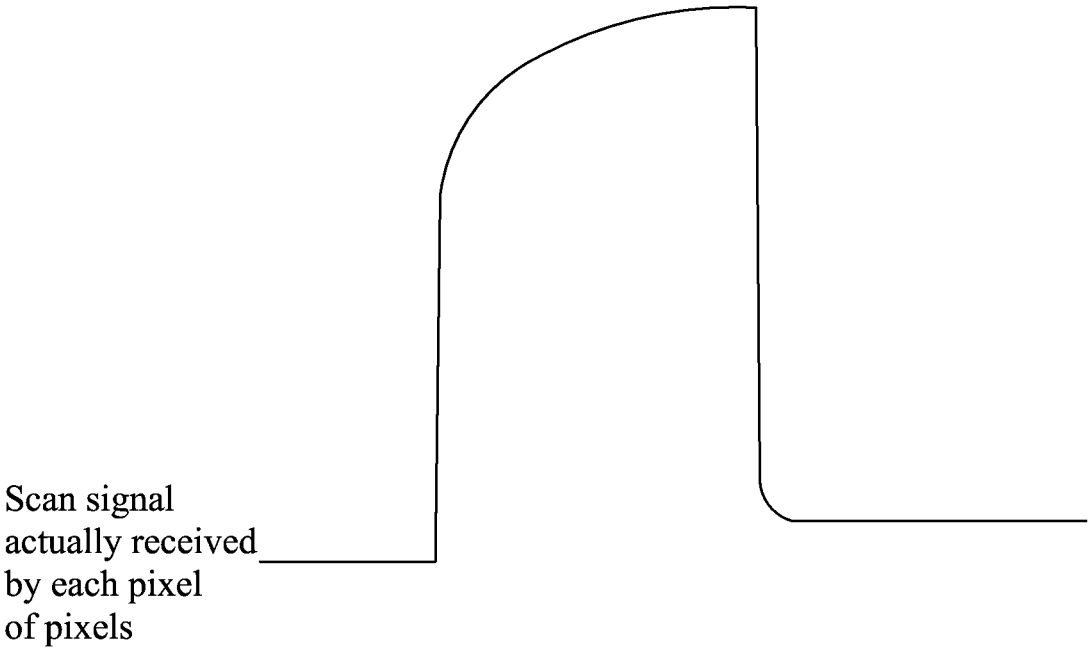
FIG. 9 is a waveform diagram of a scan signal of a plurality of scan signals actually received by each pixel of the pixels in the TFT array substrate of the present disclosure.

It is to be noted that in the TFT array substrate of the present disclosure, the first TFT T1 is correspondingly disposed in each pixel 20 of the pixels 20. Each first TFT T1 in the (N)th row of pixels 20 correspondingly has the gate electrically connected to the (N+1)th scan line GATE(N+1), the drain electrically connected to the (N)th scan line GATE(N), and the source receiving the negative supply voltage VSS. When the GOA circuit 40 drives, the GOA circuit 40 correspondingly and sequentially transmits the scan signals to the scan lines 30. The scan signal through the (N+1)th scan line GATE(N+1) is used to control each first TFT T1 in the (N)th row of pixels 20 to be turned on to pull down the scan signal through the (N)th scan line GATE(N). Therefore, the scan signal received by each pixel 20 of the pixels 20 is individually pulled down by each pixel 20 of the pixels 20, significantly reducing a falling time of the scan signal. Referring to FIG. 9, the falling time of the scan signal actually received by each pixel 20 of the pixels 20 of the present disclosure is short. A waveform of the scan signal is almost not distorted, thereby effectively preventing effects of capacitance and resistance in the AA 11 on the falling time of the scan signal from causing a driving error and each pixel 20 of the pixels 20 to be mischarged, and facilitating ensuring display quality of the display panel.

Based on the same inventive idea, the present disclosure also provides a display panel including any of the aforementioned TFT array substrates. The display panel may be an LCD panel. A TFT array substrate of the LCD panel uses the TFT array substrate in the first embodiment. The display panel may also be an OLED display panel. A TFT array substrate of the OLED display panel in the second embodiment. A plurality of structures correspondingly of the TFT array substrates are omitted here.

It is to be noted that in the TFT array substrate of the present disclosure, the first TFT T1 is correspondingly disposed in each pixel 20 of the pixels 20. Each first TFT T1 in the (N)th row of pixels 20 correspondingly has the gate electrically connected to the (N+1)th scan line GATE(N+1), the drain electrically connected to the (N)th scan line GATE(N), and the source receiving the negative supply voltage VSS. When the GOA circuit 40 drives, the GOA circuit 40 correspondingly and sequentially transmits the scan signals to the scan lines 30. The scan signal through the (N+1)th scan line GATE(N+1) is used to control each first TFT T1 in the (N)th row of pixels 20 to be turned on to pull down the scan signal through the (N)th scan line GATE(N). Therefore, the scan signal received by each pixel 20 of the pixels 20 is individually pulled down by each pixel 20 of the pixels 20, significantly reducing a falling time of the scan signal. Referring to FIG. 9, the falling time of the scan signal actually received by each pixel 20 of the pixels 20 of the present disclosure is short. A waveform of the scan signal is almost not distorted, thereby effectively preventing effects of capacitance and resistance in the AA 11 on the falling time of the scan signal from causing a driving error and each pixel 20 of the pixels 20 to be mischarged, and facilitating ensuring display quality of the display panel.

In summary, in the TFT array substrate, a first TFT is correspondingly disposed in each pixel of a plurality of pixels. Each first TFT in an (N)th row of pixels of the pixels correspondingly has a gate electrically connected to an (N+1)th scan line of a plurality of scan lines, a drain electrically connected to an (N)th scan line of the scan lines, and a source receiving a negative supply voltage. Therefore, a scan signal of a plurality of scan signals received by each pixel is individually pulled down by each pixel, thereby significantly reducing a falling time of the scan signal, and facilitating ensuring display quality of the display panel. The display panel of the present disclosure may reduce a falling time correspondingly of each scan signal of the scan signals, thereby facilitating ensuring display quality.

To persons skilled in the art, in accordance with the technical solutions and technical ideas of the present disclosure, various changes and modifications may be made to the description above. All these changes and modifications are within the protection scope of the claims of the present disclosure.

What is claimed is:

1. A thin film transistor (TFT) array substrate, comprising: a substrate, a plurality of pixels disposed on the substrate, a plurality of scan lines arranged in order on the substrate, and a gate driver on array (GOA) circuit disposed on the substrate;

wherein the pixels are arranged in an array; wherein the GOA circuit is located outside a region where the pixels are located; wherein the scan lines are all connected to the GOA circuit, and each scan line is correspondingly electrically connected to one row of pixels of the pixels; and wherein each pixel of the pixels correspondingly comprises a first TFT, and except for a last row of pixels of the pixels, each first TFT of an (N)th row of pixels of the pixels correspondingly has a gate electrically connected to an (N+1)th scan line of the scan lines, a drain electrically connected to an (N)th scan line of the scan lines, and a source receiving a negative supply voltage, where N is a positive integer.

2. The TFT array substrate of claim 1, wherein the substrate comprises an active area (AA) and a non-AA at a periphery of the AA; and wherein the pixels are all located in the AA, and the GOA circuit is located in the non-AA.

3. The TFT array substrate of claim 1, wherein the GOA circuit correspondingly and sequentially transmits a plurality of scan signals to the scan lines in one frame period.

4. The TFT array substrate of claim 1, wherein each first TFT of the last row of pixels correspondingly has a gate receiving a start signal, a drain electrically connected to a last scan line of the scan lines, and a source receiving the negative supply voltage.

5. A display panel, comprising: the TFT array substrate of claim 1.

6. The TFT array substrate of claim 1, wherein the GOA circuit comprises multi-stage GOA units, each stage of the multi-stage GOA units is correspondingly electrically connected to one scan line of the scan lines, and each stage of the multi-stage GOA units correspondingly comprises a pull-up controlling module, a pull-up module, a down transfer module, a pull-down module, a pull-down maintaining module, and a boost capacitor;

wherein except for a first stage GOA unit and a last stage GOA unit of the multi-stage GOA units, in an (n)th stage GOA unit of the multi-stage GOA units, where n is a positive integer, the pull-up controlling module comprises an eleventh TFT, a twelfth TFT, and a thirteenth TFT; wherein the eleventh TFT has a gate receiving a first clock signal, a source receiving a stage transfer signal of an (n−1)th stage GOA unit of the multi-stage GOA units, and a drain electrically connected to a source of the twelfth TFT; wherein the twelfth TFT has a gate receiving the first clock signal, and a drain electrically connected to a first node; and wherein the thirteenth TFT has a gate electrically connected the down transfer module, a source electrically connected to the drain of the eleventh TFT, and a drain electrically connected to a second node;

the pull-up module comprises a twenty-first TFT and a twenty-second TFT; wherein the twenty-first TFT has a gate electrically connected to the first node, a source receiving a second clock signal, and a drain electrically connected to a corresponding scan line of the scan lines and outputting a scan signal; and wherein the twenty-second TFT has a gate electrically connected to the first node, a source receiving the second clock signal, and a drain electrically connected to the second node;

the down transfer module comprises a thirty-first TFT; wherein the thirty-first TFT has a gate electrically connected to the first node, a source receiving the second clock signal, and a drain electrically connected to the gate of the thirteenth TFT and outputting the stage transfer signal;

the pull-down module comprises a forty-first TFT, a forty-second TFT, and a forty-third TFT; wherein the forty-first TFT has a gate receiving a scan signal of an (n+1)th stage GOA unit of the multi-stage GOA units, a source electrically connected to the first node, and a drain electrically connected to a source of the forty-second TFT; wherein the forty-second TFT has a gate receiving the scan signal of the (n+1)th stage GOA unit, and a drain receiving a first constant low voltage; and wherein and the forty-third TFT has a gate receiving the scan signal of the (n+1)th stage GOA unit, a source electrically receiving the scan signal, and a drain receiving a second constant low voltage;

the pull-down maintaining module comprises a fifty-first TFT, a fifty-second TFT, a fifty-third TFT, a fifty-fourth TFT, a fifty-fifth TFT, a fifty-sixth TFT, a fifty-seventh TFT, a fifty-eighth TFT, and a fifty-ninth TFT; wherein the fifty-first TFT has a gate and a source both receiving a constant high voltage, and a drain electrically connected to a source of the fifty-second TFT; wherein the fifty-second TFT has a gate electrically connected to the first node, and a drain receiving the first constant low voltage; wherein the fifty-third TFT has a gate electrically connected to the drain of the fifty-first TFT, a source receiving the constant high voltage, and a drain electrically connected to a source of the fifty-fourth TFT; wherein the fifty-fourth TFT has a gate electrically connected to the first node, and a drain receiving the first constant low voltage; wherein the fifty-fifth TFT has a gate electrically connected to the drain of the fifty-third TFT, a source electrically connected to the first node, and a drain electrically connected to the drain of the eleventh TFT; wherein the fifty-sixth TFT has a gate electrically connected to the drain of the fifty-third TFT, a source electrically to the drain of the fifty-fifth TFT, and a drain receiving the first constant low voltage; wherein the fifty-seventh TFT has a gate electrically connected to the drain of the fifty-third TFT, a source receiving the stage transfer signal, and a drain receiving the first constant low voltage; wherein the fifty-eighth TFT has a gate electrically connected to the drain of the fifty-third TFT, a source electrically connected to the second node, and a drain receiving the second constant low voltage; and wherein the fifty-ninth TFT has a gate electrically connected to the drain of the fifty-third TFT, a source receiving the scan signal, and a drain receiving the second constant low voltage; and the boost capacitor has one end electrically connected to the first node, and another end receiving the scan signal.

7. The TFT array substrate of claim 6, wherein in the first stage GOA unit, the source of the eleventh TFT receives a start signal; and wherein in the last stage GOA unit, the gate of the forty-first TFT, the gate of the forty-second TFT, and the gate of the forty-third TFT receive the start signal.

8. The TFT array substrate of claim 1, further comprises: a plurality of data lines disposed on the substrate, wherein each column of pixels of the pixels is correspondingly electrically connected to one data line of the data lines.

9. The TFT array substrate of claim 8, wherein each pixel of the pixels correspondingly further comprises: a second TFT, a first capacitor, and a pixel electrode; wherein the second TFT has a gate electrically connected to a corresponding scan line of the scan lines, a source electrically connected to a corresponding data line of the data lines, and a drain electrically connected to the pixel electrode; and wherein the first capacitor has one end electrically connected to the pixel electrode and another end being grounded.

10. The TFT array substrate of claim 8, wherein each pixel of the pixels correspondingly further comprises: a third TFT, a fourth TFT, a second capacitor, and an anode; wherein the third TFT correspondingly has a gate electrically connected to a corresponding scan line of the scan lines, a source electrically connected to a corresponding data line of the data lines, and a drain electrically connected to a gate of the fourth TFT; wherein the fourth TFT has a drain receiving a positive supply voltage, and a source electrically connected to the anode; wherein the second capacitor has one end electrically connected to the anode and another end being grounded.

* * * * *